US007479730B2

(12) United States Patent
Oh

(10) Patent No.: US 7,479,730 B2
(45) Date of Patent: Jan. 20, 2009

(54) FIELD EMISSION DEVICE

(75) Inventor: Tae-Sik Oh, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/391,447

(22) Filed: Mar. 29, 2006

(65) Prior Publication Data

US 2006/0267482 A1 Nov. 30, 2006

(30) Foreign Application Priority Data

May 24, 2005 (KR) ..... 10-2005-0043746

(51) Int. Cl.
*H01J 63/04* (2006.01)

(52) U.S. Cl. ..... 313/497; 313/310

(58) Field of Classification Search ..... 313/495–497, 313/309–311; 445/24

See application file for complete search history.

(56) References Cited

U.S. PATENT DOCUMENTS 5,612,712 A * 3/1997 Kumar et al. ..... 345/75.2
5,710,483 A * 1/1998 Peng ..... 313/497
5,757,138 A * 5/1998 Tsai ..... 315/169.3
6,879,097 B2 * 4/2005 Dunphy ..... 313/495
2001/0025962 A1 * 10/2001 Nakamoto ..... 257/137
2003/0184213 A1 * 10/2003 Hofmann et al. ..... 313/495
2004/0145298 A1 * 7/2004 Seon et al. ..... 313/495
2004/0232823 A1 * 11/2004 Nakata et al. ..... 313/495
2004/0239235 A1 * 12/2004 Oono ..... 313/497
2005/0184648 A1 * 8/2005 Chi et al. ..... 313/497
2005/0189865 A1 * 9/2005 Lee ..... 313/495
2005/0242707 A1 * 11/2005 Hwang ..... 313/497

* cited by examiner

*Primary Examiner*—Toan Ton
*Assistant Examiner*—Hana A Sanei
(74) *Attorney, Agent, or Firm*—Robert E. Bushnell, Esq.

(57) ABSTRACT

A field emission device (FED) includes an electrostatic lens structure. The FED includes: a rear substrate; a cathode electrode on the upper surface of the rear substrate; at least one group of emitters emitting electron beams and arranged in a vertical row on the upper surface of the cathode electrode; a gate electrode placed on the upper surface of the cathode electrode to extract electrons from the emitters and having horizontal first openings respectively corresponding to the emitters; a first insulating layer interposed between the gate electrode and the cathode electrode; a focus electrode placed on the upper surface of the gate electrode and having a vertical second opening portion connected to the first opening portions of the corresponding group of emitters; a second insulating layer interposed between the focus electrode and the gate electrode; a front substrate disposed a predetermined distance above the rear substrate with an anode electrode on the lower surface thereof; and a fluorescent pattern formed on the lower surface of the anode electrode, emitting light when collided of the electron beams; with the gate electrode and the focus electrode forming a quadrupole lens structure.

20 Claims, 13 Drawing Sheets

Vf=0V Vf=-30V Vf=-40V Vf=-50V

FIELD EMISSION DEVICE

CLAIM OF PRIORITY

This application makes reference to, incorporates the same herein, and claims all benefits accruing under 35 U.S.C. §119 from an application for FIELD EMISSION DEVICE earlier filed in the Korean Intellectual Property Office on 24 May 2005 and there duly assigned Serial No. 10-2005-0043746.

BACKGROUND OF THE INVENTION

1. Field of the Invention

The present invention relates to a field emission device, and more particularly, to a field emission device in which an electrostatic quadrupole lens structure is constructed between an emitter on a cathode and an anode, improving focusing effect.

2. Description of the Related Art

Generally, a field emission device (FED) can be applied to a planar display device or a light emitting device. An FED includes a gate electrode that applies an electric field to an emitter arranged on a cathode electrode, so that the emitter emits electrons. The electrons collide with a fluorescent material coated on an anode electrode, and thus light is emitted. An FED with a double gate structure further includes a focus electrode in addition to a gate electrode which is described above.

The brightness and color purity of the FED emitting light by using electron beams emitted from a cold cathode depends not only on the material and structure of the emitter, which is the source of electrons, but also on the FED's ability to accurately focus an emitted electron beam accurately on a fluorescent material pattern to emit light. That is, to realize a high resolution display device using an FED, techniques of focusing the electron beam on the target fluorescent material pattern and not adjacent fluorescent materials are required.

Moreover, when a high voltage is applied to the anode to obtain high brightness and durability, the distance between the emitter and the anode must be increased for electrical stability. However, as the distance between the emitter and the anode increases, the electron beams are more likely to disperse. Thus, a structure that can transform an electron beam to correspond to the fluorescent material pattern and focus the beam accurately is required.

A conventional FED with a double gate structure includes an emitter emitting electrons on a cathode electrode; a gate electrode thereon which extracts electrons and has a first opening portion surrounding the emitter; and a focus electrode placed thereon which focuses the extracted electron beams and has a second opening portion having a common center with the first opening. The gate electrode is insulated from the cathode, and the focus electrode is insulated from the gate electrode.

When an electron beam emitted from one FED cannot radiate a pixel area sufficiently, a plurality of FEDs can be arranged to correspond to a pixel area.

When the focus voltage Vf is 0 V, electron beams having a circular shape reach a wide area, and as the voltage increases, the area of the electron beams decreases. However, when the focus voltage is about 50 V, a halo appears around the electron beam thus increasing the area of the electron beams.

Generally, in a display device using a FED, the fluorescent material pattern has a striped pattern with a longer vertical length than horizontal width. Since an electron beam reaching the anode has a circular shape according to the conventional double gate structure, the electron beam is likely to deviate from the width of the fluorescent material. Particularly, when two or more groups of emitters including emitters arranged in a vertical row are arranged horizontally with respect to one pixel area, the width of an electron beam increases.

Also, the optimal focusing effect is achieved at a focus voltage of −40 V. That is, to obtain sufficient focusing effect in a conventional double gate structure, the potential between a focus electrode and a gate electrode may be large, and thus an electrical breakdown may occur between the focus electrode and the gate electrode.

SUMMARY OF THE INVENTION

The present invention provides a field emission device (FED) which focuses an electron beam emitted from an emitter, transforming a cross-section of the electron beam into a striped shape corresponding to a fluorescent pattern.

The present invention also provides an FED which includes a focus electrode having a lower electric potential than a gate electrode.

Further, the present invention provides an FED in which electron beams from a group of emitters arranged in a vertical row and corresponding to a pixel area are focused on the center of the emitter group. When at least two groups of emitters are arranged in a horizontal row corresponding to a pixel, electron beams of each group are focused toward the center axis of the groups.

According to an aspect of the present invention, there is provided an FED including: a rear substrate; a cathode electrode on the upper surface of the rear substrate; at least one group of emitters emitting electron beams and arranged in a vertical row on the upper surface of the cathode electrode; a gate electrode placed on the upper side of the cathode electrode to extract electrons from the emitters and having horizontal first openings respectively corresponding to the emitters; a first insulating later interposed between the gate electrode and the cathode electrode; a focus electrode placed on the upper side of the gate electrode and having a vertical second opening portion connected to the first opening portions of the corresponding group of emitters; a second insulating layer interposed between the focus electrode and the gate electrode; a front substrate disposed a predetermined distance above the rear substrate with an anode electrode on the lower surface thereof; and a fluorescent pattern formed on the lower surface of the anode electrode, emitting light when collided of the electron beams; with the gate electrode and the focus electrode forming a quadrupole lens structure.

That is, an electrostatic quadrupole lens of the FED may be formed of the first openings formed in the gate electrode to correspond to each emitter and a second opening formed in the focus electrode to correspond to the emitter groups.

According to another aspect of the present invention, there is provided an FED including: a rear substrate; a cathode electrode on the upper surface of the rear substrate; two or more groups of emitters emitting electron beams and arranged on the upper surface of the cathode electrode; a gate electrode placed on the upper surface of the cathode electrode to extract electrons from the emitters and having horizontal first opening portions respectively corresponding to the emitters; a first insulating layer interposed between the gate electrode and the cathode electrode; a focus electrode placed on the upper surface of the gate electrode and having a vertical second opening portion connected to the first opening portions of the corresponding groups of emitters; a second insulating layer interposed between the focus electrode and the gate electrode; a front substrate disposed a predetermined distance above the rear substrate with an anode electrode on the lower surface thereof; and a fluorescent pattern formed on the lower surface of the anode electrode, emitting light when collided with the electron beams; with two or more groups of emitters being arranged in a horizontal row, and the quadrupole lens structure formed of the gate electrode and the focus electrode deflects groups of electron beams emitted from each group of the emitters so that two or more electron beams overlap with one another.

The vertical axis of the first opening portion is displaced to the right and left from the vertical axis of the corresponding emitter, and the electron beams deviate in a direction opposite to the displacement. The first opening portions corresponding to the same emitters in a group may be displaced in the same direction by the same amount. The deviation direction may be the opposite of the center of the emitters in a group.

The first opening portions may be deviated a first direction from the vertical axis of the corresponding emitters and deflect the electron beams in a second direction opposite to the first direction.

As described above, 'vertical' refers to an object whose vertical length is greater than its horizontal width, and 'horizontal' refers to an object whose horizontal width is greater than its vertical length. The terms 'vertical' and 'horizontal' do not denote absolute directions but a relative perpendicular relation. Also, a pixel area indicates a uniform fluorescent pattern in a display device, and a sub-pixel is a one-color light emitting area in a color display device.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1A:
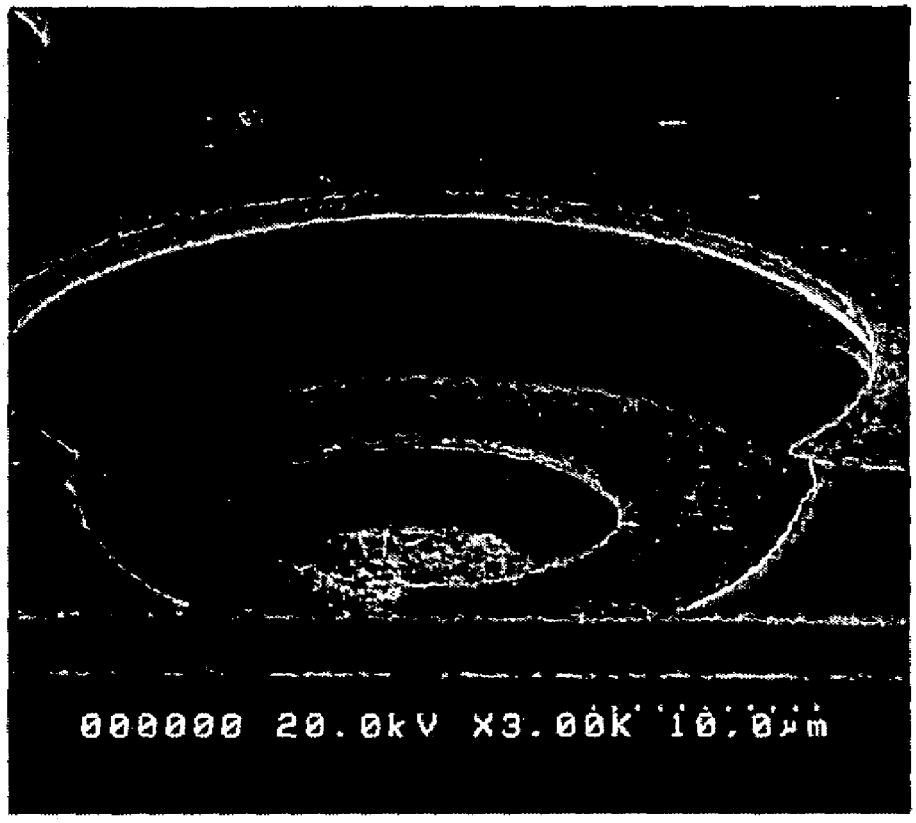
FIG. 1A (CONVENTIONAL ART)
FIG. 1A is an SEM image of a conventional field emission device (FED) with a double gate structure.
Figure 1B:
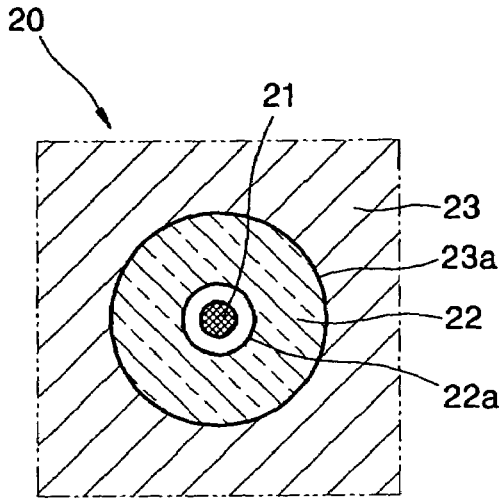
FIG. 1B (CONVENTIONAL ART)
FIG. 1B is a plan view of the FED of FIG. 1A.

Turning now to the drawings, FIG. 1A is an SEM photograph of a conventional FED 20 with a double gate structure, and FIG. 1B is a plan view illustrating the FED 20 of FIG. 1. The conventional FED 20 with a double gate structure includes an emitter 21 emitting electrons on a cathode electrode; a gate electrode 22 thereon which extracts electrons and has a first opening portion 22*a* surrounding the emitter 21; and a focus electrode 23 placed thereon which focuses the extracted electron beams and has a second opening portion 23*a* having a common center with the first opening 22*a*. The gate electrode 22 is insulated from the cathode, and the focus electrode 23 is insulated from the gate electrode 22.

Figure 2A:
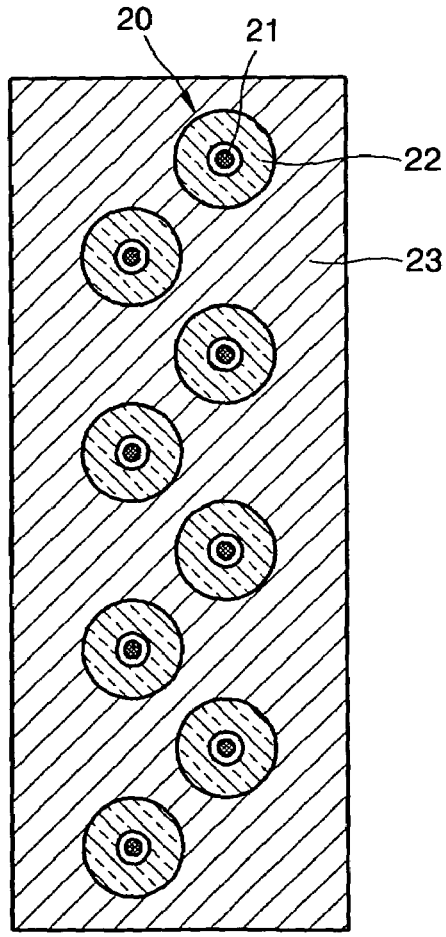
FIG. 2A (CONVENTIONAL ART)
FIG. 2A is a plan view of conventional FEDs with a double gate structure arranged to correspond to pixel areas.

FIG. 2A is a plan view of conventional FEDs 20 with a double gate structure corresponding to pixel areas. When an electron beam emitted from one FED 20 cannot radiate a pixel area sufficiently, a plurality of FEDs 20 can be arranged to correspond to a pixel area as shown in FIG. 2A.

Figure 2B:
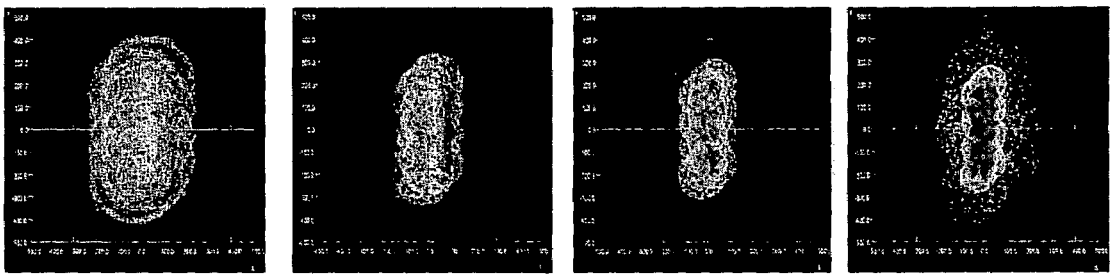
FIG. 2B (CONVENTIONAL ART)
FIG. 2B is a simulation image of an electron spot on the surface of an anode of the FEDs of FIG. 2A.

FIG. 2B is a simulation image of an electron beam spot on an anode surface of the FEDs 20 of FIG. 2A for various voltages applied to the focus electrode 23. When the focus voltage Vf is 0 V (volts), electron beams having a circular shape reach a wide area, and as the voltage increases, the area of the electron beams decreases. However, when the focus voltage is about 50 V, a halo appears around the electron beam, thus increasing the area of the electron beams.

Generally, in a display device using a FED, the fluorescent material pattern has a striped pattern with a longer vertical length than a horizontal width. Since an electron beam reaching the anode has a circular shape according to the conventional double gate structure, the electron beam is likely to deviate from the width of the fluorescent material. Particularly, as shown in FIG. 2A, when two or more groups of emitters including emitters arranged in a vertical row are arranged horizontally with respect to one pixel area, the width of an electron beam increases.

Also, referring to FIG. 2B, the optimal focusing effect is achieved at a focus voltage of −40 V. That is, to obtain sufficient focusing effect in a conventional double gate structure, the potential between a focus electrode and a gate electrode may be large, and thus an electrical breakdown may occur between the focus electrode and the gate electrode.

As described above, 'vertical' refers to an object whose vertical length is greater than its horizontal width, and 'horizontal' refers to an object whose horizontal width is greater than its vertical length. The terms 'vertical' and 'horizontal' do not denote absolute directions but a relative perpendicular relation. Also, a pixel area indicates a uniform fluorescent pattern in a display device, and a sub-pixel is a one-color light emitting area in a color display device.

Figure 3:
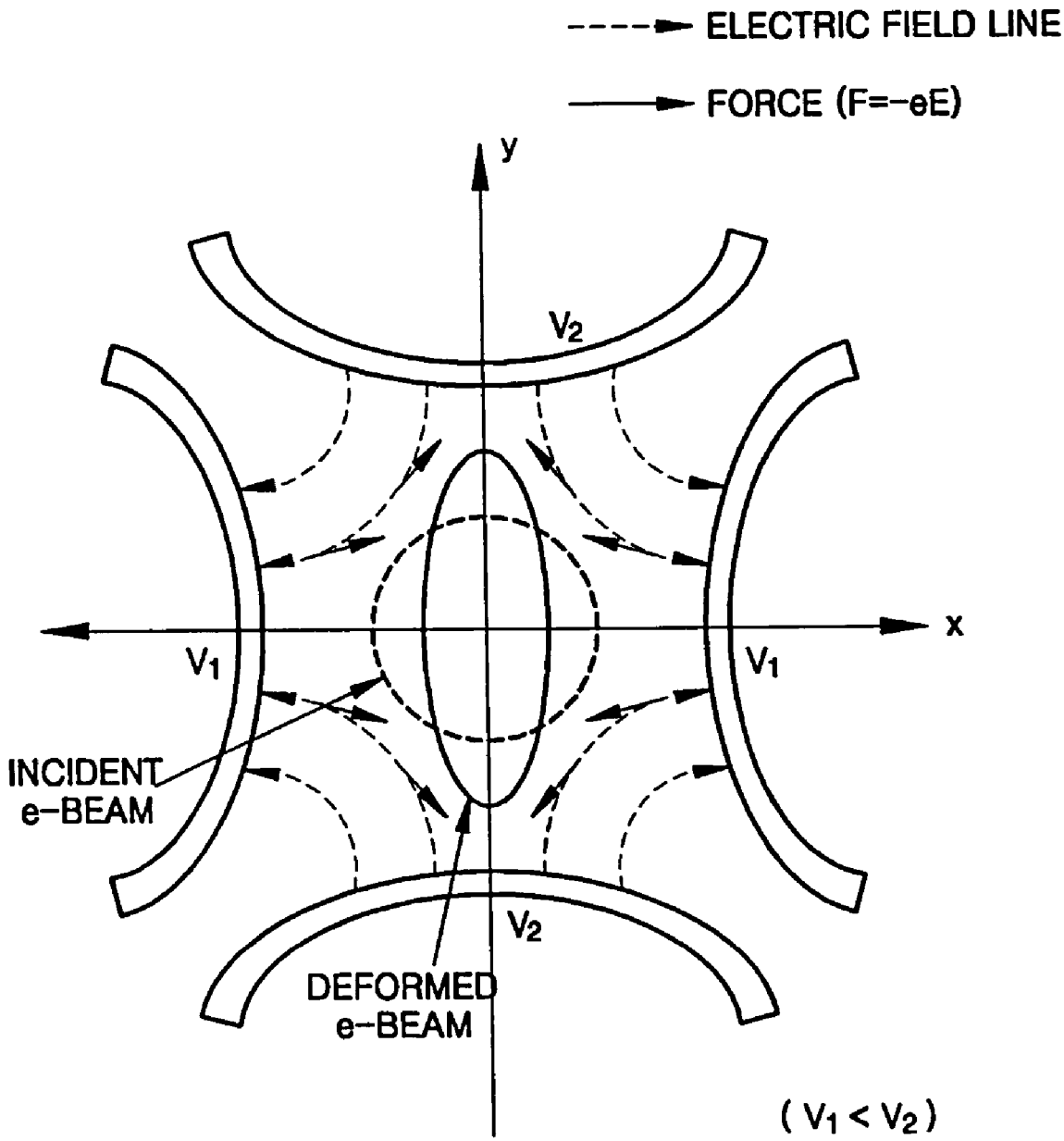
FIG. 3 is a conceptual diagram illustrating the concept of an electrostatic quadrupole lens.
Figure 4:
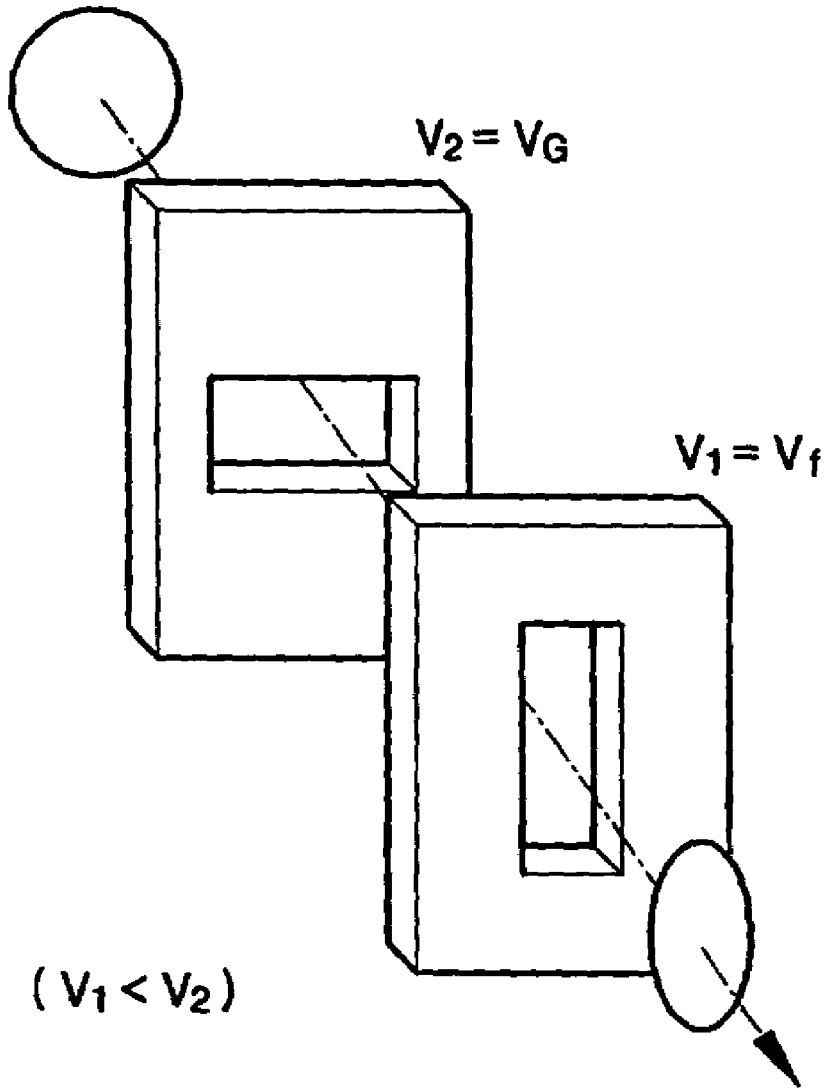
FIG. 4 is a perspective view of a quadrupole lens structure of an FED according to the embodiment of the present invention.

FIG. 4 is a perspective view of a quadrupole lens structure of a FED according to an embodiment of the present invention. Generally, a fluorescent pattern of a display device using a FED has a striped form with a vertical length longer than a horizontal width. Accordingly, the quadrupole lens structure in the FED, as shown in FIG. 3, may have a greater vertical length and a smaller horizontal width of a cross section of an electron beam.

In a FED, a positive voltage Vg is applied to the gate electrode installed close to the emitter and a lower voltage is applied to the focus electrode. Thus a quadrupole lens structure can be provided in which the $V_1$ is equal to $V_f$, and $V_2$ is equal to $V_g$ ($V_1<V_2$) by the gate electrode and the focus electrode. That is, in the quadrupole lens structure in the present embodiment, the gate electrode has a horizontal opening to be a pair of horizontal electrodes facing each other and a focus electrode has a vertical opening to be a pair of vertical electrodes facing each other.

Figure 5A:
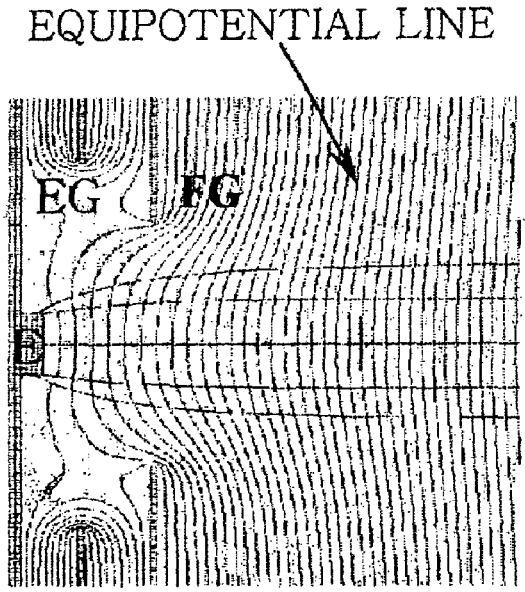
FIGS. 5A and 5B are simulation images of the trajectory of an electron beam of an FED according to an embodiment of the present invention.
Figure 5B:
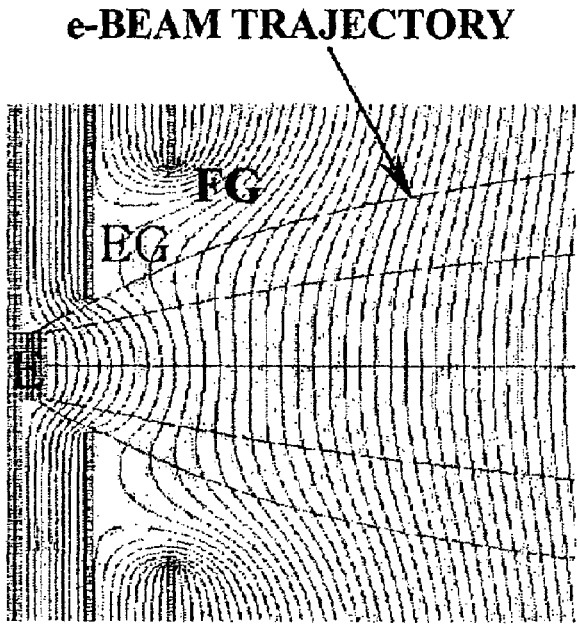

FIGS. 5A and 5B are simulation images of the trajectory of an electron beam of an FED according to an embodiment of the present invention. FIG. 5A shows the horizontal surface of an FED and FIG. 5B shows a vertical surface of an FED. As described above, the width of electron beams emitted from the emitters is reduced and the height is increased by a quadrupole lens structure formed by the gate electrode EG and the focus electrode FG. Accordingly, a maximal amount of the light emitting surface of a corresponding fluorescent pattern may be used without affecting the adjacent fluorescent pattern.

Figure 6:
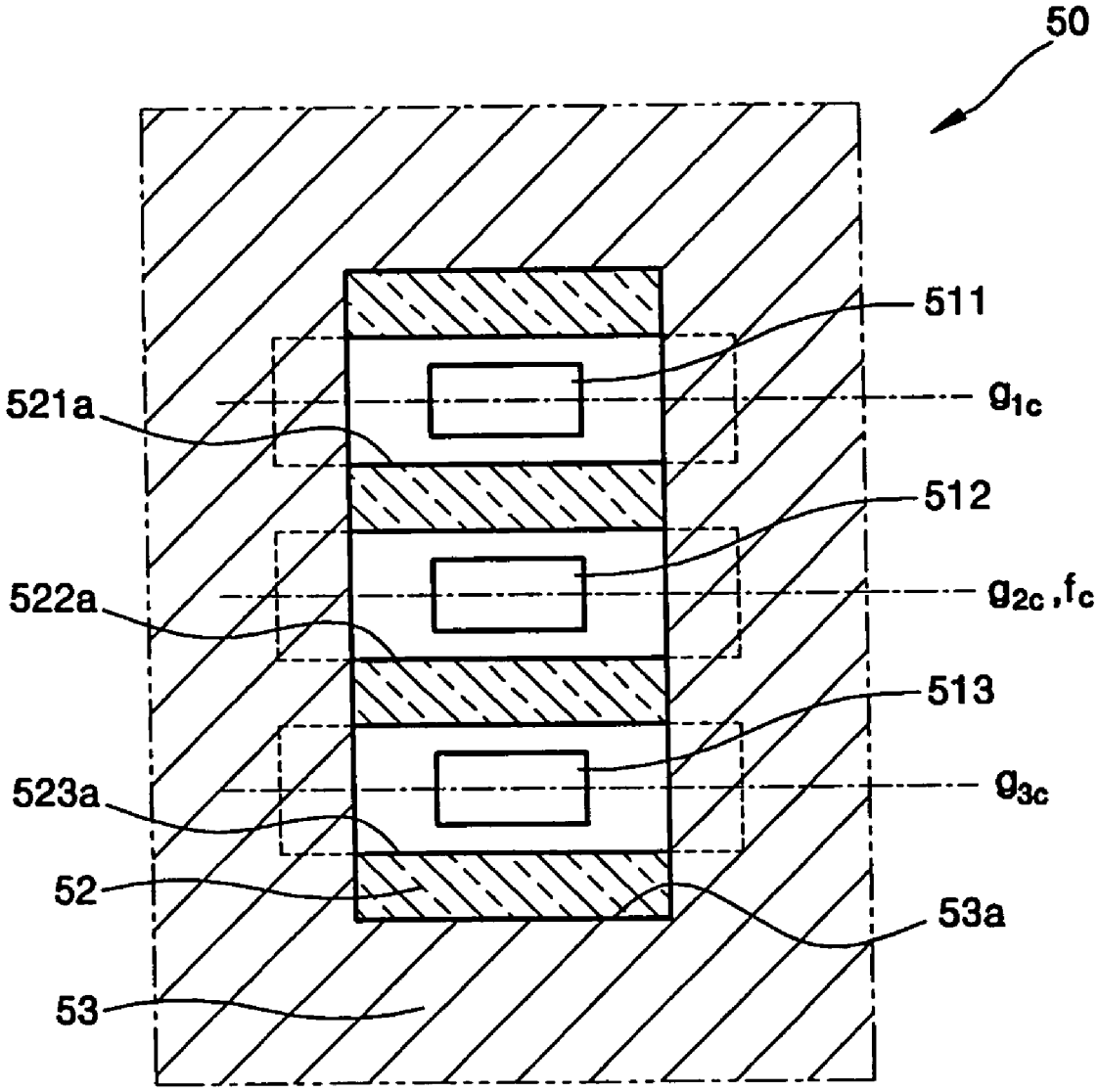
FIG. 6 is a plan view of an FED according to a first embodiment of the present invention.

FIG. 6 is a plan view of a FED according to a first embodiment of the present invention. The FED according to the first embodiment of the present invention includes a rear substrate (not shown) and a cathode electrode (not shown) on the upper surface of the rear substrate. Emitters 511, 512, and 513 corresponding to a pixel are arranged on the cathode electrode vertical row. The number of groups of emitters may be two or greater.

A gate electrode 52 extracting electrons from the emitters 511, 512 and 513 is placed on the upper side of the cathode electrode, and horizontal first opening portions 521*a*, 522*a*, and 523*a* corresponding to the emitters 511, 512, and 513 are formed in the gate electrode 52. The first opening portion of FIG. 6 is a rectangle that is longer horizontally than vertically.

A focus electrode 53 is formed on the gate electrode 52. The focus electrode 53 includes a vertical second opening portion 53*a* which is longer vertically than horizontally. The second opening portion 53*a* is connected to the first opening portions 521*a*, 522*a*, and 523*a* corresponding to the emitters 511, 512, and 513.

Insulating layers are interposed between the cathode electrode and the gate electrode 52, and between the gate electrode 52 and the focus electrode 53. A voltage $V_g$, which is mostly positive and greater than the voltage applied to the cathode electrode, is applied to the gate electrode 52 to extract electrons, and a voltage lower than $V_g$ is applied to the focus electrode 53.

Though not shown in FIG. 6, a front substrate is disposed a predetermined distance above the rear substrate. An anode electrode to which a high voltage is applied is formed on the front substrate, and the lower surface of the anode electrode includes a fluorescent pattern emitting light due to the collision of electron beams. The fluorescent pattern is a vertical stripe, and may be in the form of a vertical rectangle which is longer vertically than horizontally with respect to a pixel.

As described above, a plurality of first opening portions to which a relatively high voltage is applied and the second opening portion to which a relatively low voltage is applied are connected, and thus build an electrostatic quadrupole lens structure. The quadrupole lenses transform a cross section of the electron beams emitted from each emitter into a shape corresponding to the form of the fluorescent pattern as described in FIGS. 3 through 5.

However, the emitters 511 and 513 which deviate from the center of the emitters 511 through 513 have an asymmetric quadrupole lens structure which is deviated a predetermined distance from the horizontal axis $f_c$ of the second opening portion 53*a*. Here, electron beams are deflected in the deviation direction of the horizontal axis of the second opening portion to the horizontal axis of the first opening portion, such as $g_{1c}$.

Figure 7:
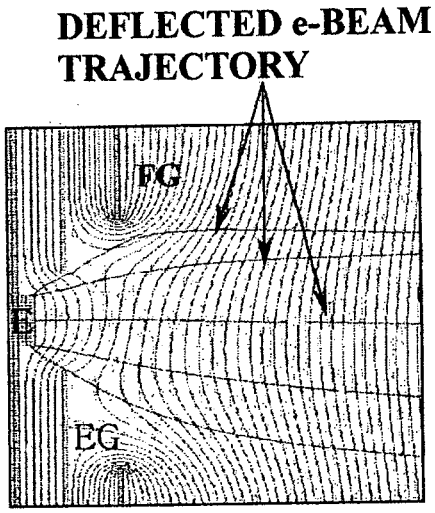
FIG. 7 is a simulation image of the trajectory of an electron beam passing through the asymmetric quadrupole lens.

FIG. 7 is a simulation image of the trajectory of an electron beam according to an asymmetric quadrupole lens structure. The second opening portion of the focus electrode (FG) 53 is placed below the center of the emitters and equipotential lines are inclined with respect to the course of electron beams, and thus the electron beams deflect downward. Accordingly, the emitters 511 and 513 which are deviated from the center of the emitters 511 through 513 have asymmetric quadrupole lens structures of which the horizontal axes $g_{1c}$ and $g_{3c}$ of the first opening portions 521*a* and 523*a*, respectively, are deviated a predetermined distance from the horizontal axis $_{2c}$, $f_c$ of the second opening portion 53*a*.

Figure 8:
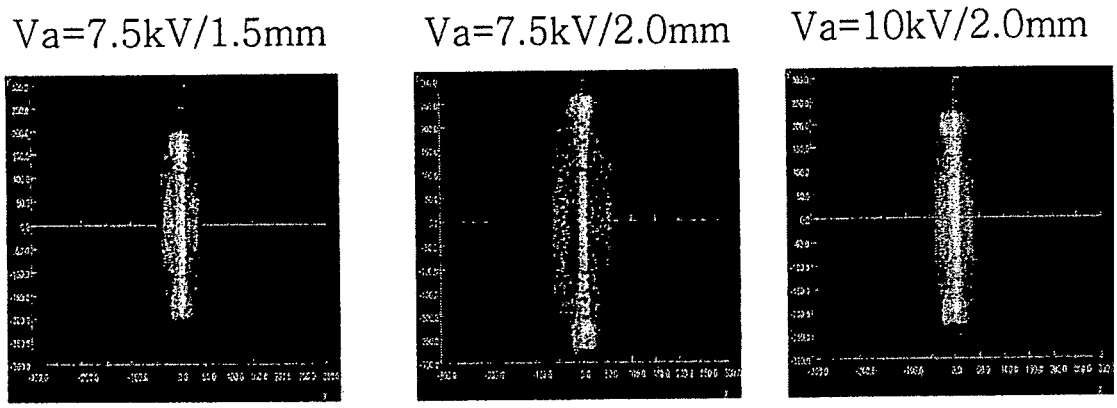
FIG. 8 is a simulation image of an electron beam spot that reached the surface of the anode of the FED illustrated in FIG. 6.

FIG. 8 is a simulation image of an electron beam spot that has reached the surface of the anode according to the first embodiment of the present invention. As described above, it can be seen that vertically long electron beams are generated.

Figure 9A:
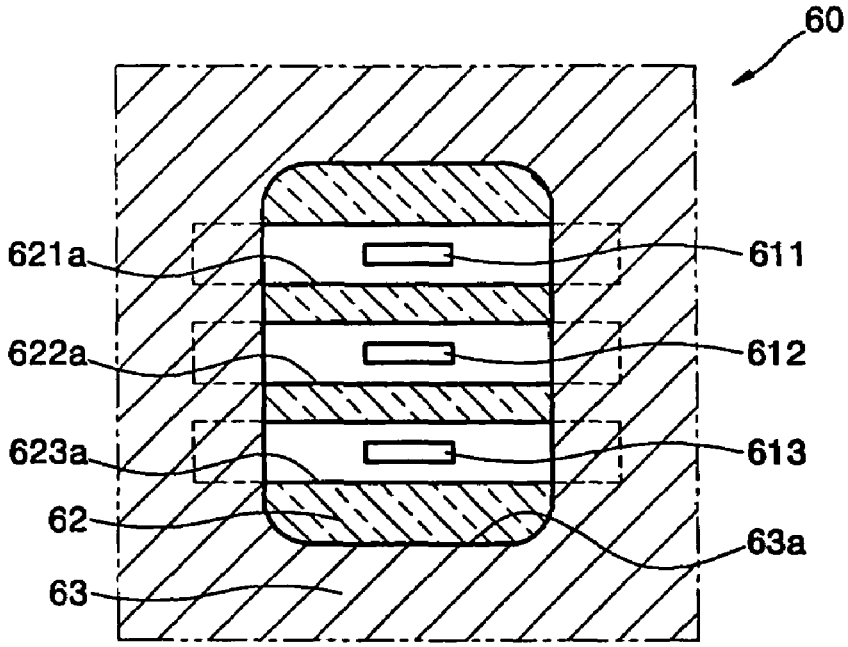
FIGS. 9A and 9B are plan views of FEDs according to second and third embodiments of the present invention.
Figure 9B:
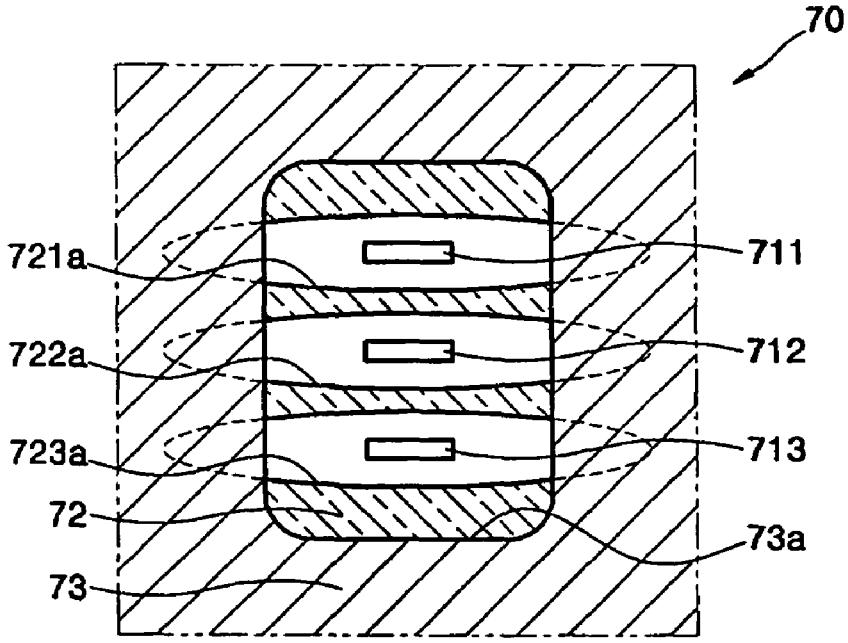

FIGS. 9A and 9B are plan views of FEDs 60 and 70 according to second and third embodiments of the present invention. The quadrupole lens structure of the FED 60 according to the second embodiment can be formed of gate electrode 62, focus electrode 63, first opening portions 621*a*, 622*a*, and 623*a* respectively corresponding to emitters 611, 612, and 613 and a second opening portion 63*a* which is a vertical oval or rectangle with rounded corners connected to the first opening portions 611*a*, 612*a*, and 623*a*. Further, the quadrupole lens structure of the FED 70 according to the third embodiment can be formed of gate electrode 72, focus electrode 73, first opening portions 721*a*, 722*a*, and 723*a*, which are horizontal ovals, respectively corresponding to emitters 711, 712, and 713, and a second opening portion 73*a* which is a vertical oval or rectangle with rounded corners connected to the first opening portions 721*a*, 722*a*, and 723*a*.

Figure 10:
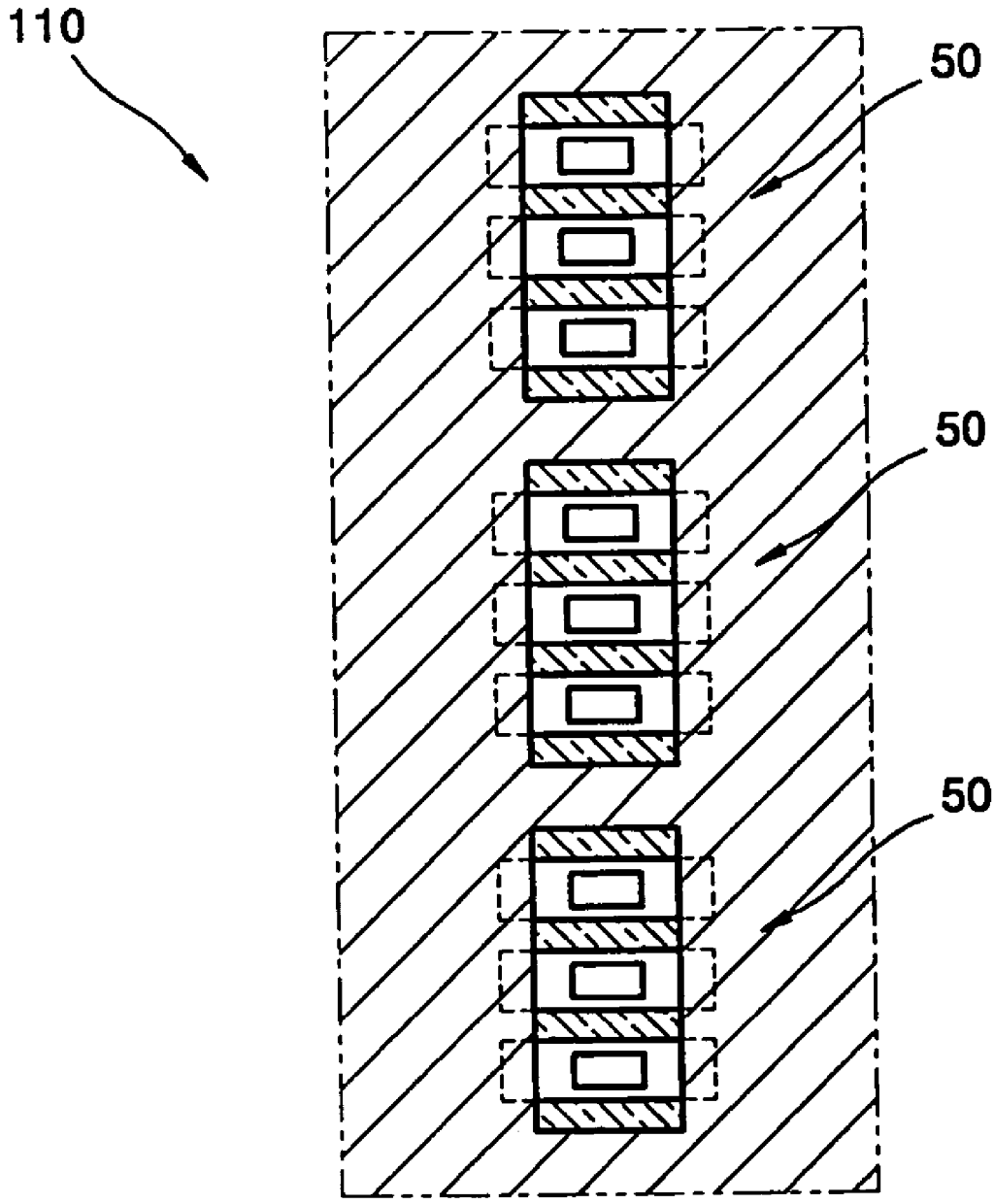
FIG. 10 is a plan view of an FED according to a fourth embodiment of the present invention.
Figure 11:
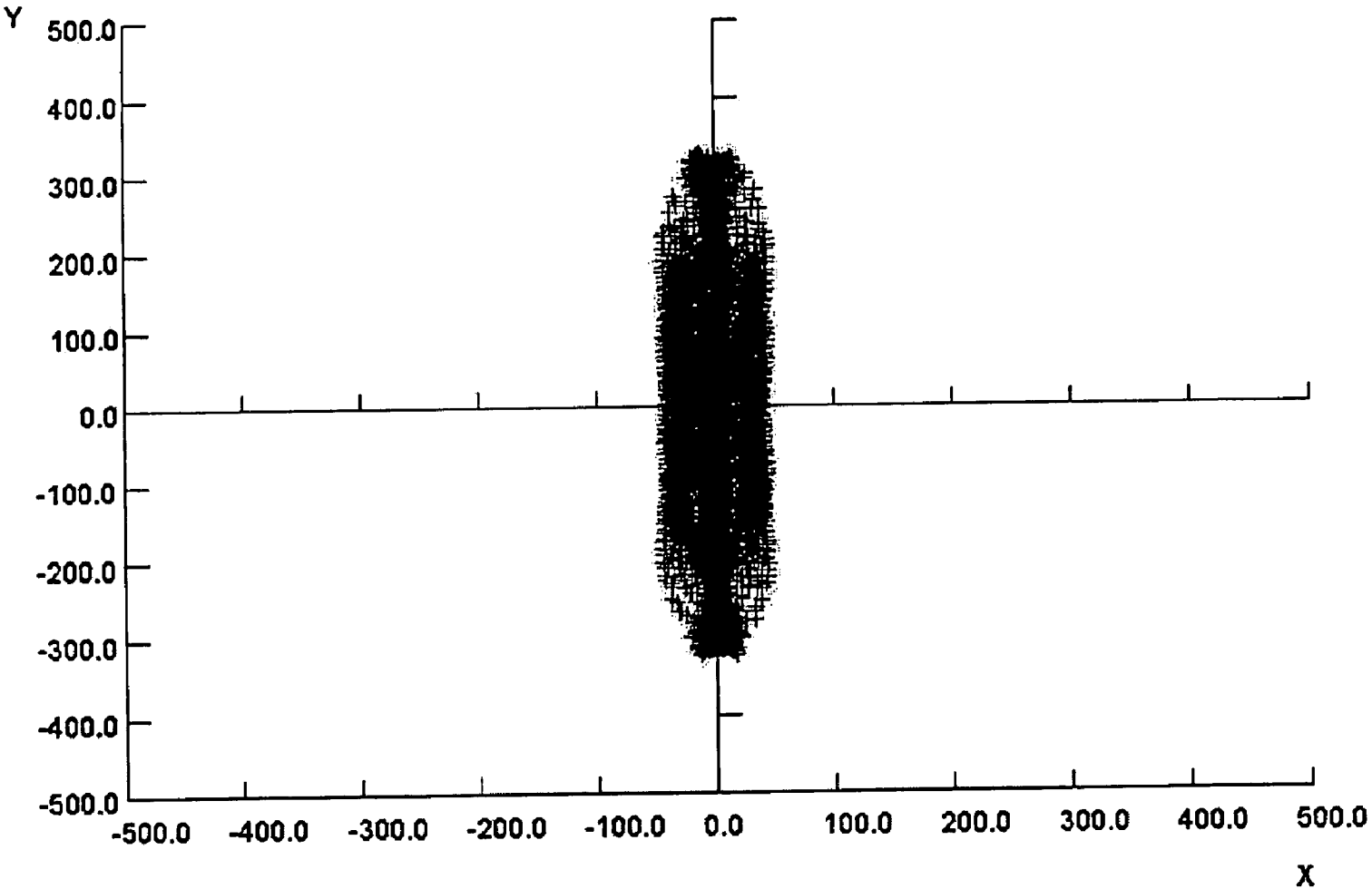
FIG. 11 is a simulation image of an electron beam spot that reached the surface of an anode of the FED illustrated in FIG. 10 according to a fourth embodiment of the present invention.

FIG. 10 is a plan view of an FED 110 according to a fourth embodiment of the present invention. The FED 110 according to the fourth embodiment includes two or more FEDs 50 in a vertical row in an area corresponding to a pixel area. That is, two or more groups of emitters are arranged in a vertical row with respect to a pixel area, and first opening portions and a second opening portion corresponding to each of the groups of emitters. FIG. 11 is a simulation image of an electron beam spot that has reached the surface of an anode according to the fourth embodiment of the present invention as shown in FIG. 10. Two or more groups of emitters can correspond to a fluorescent pattern.

Figure 12:
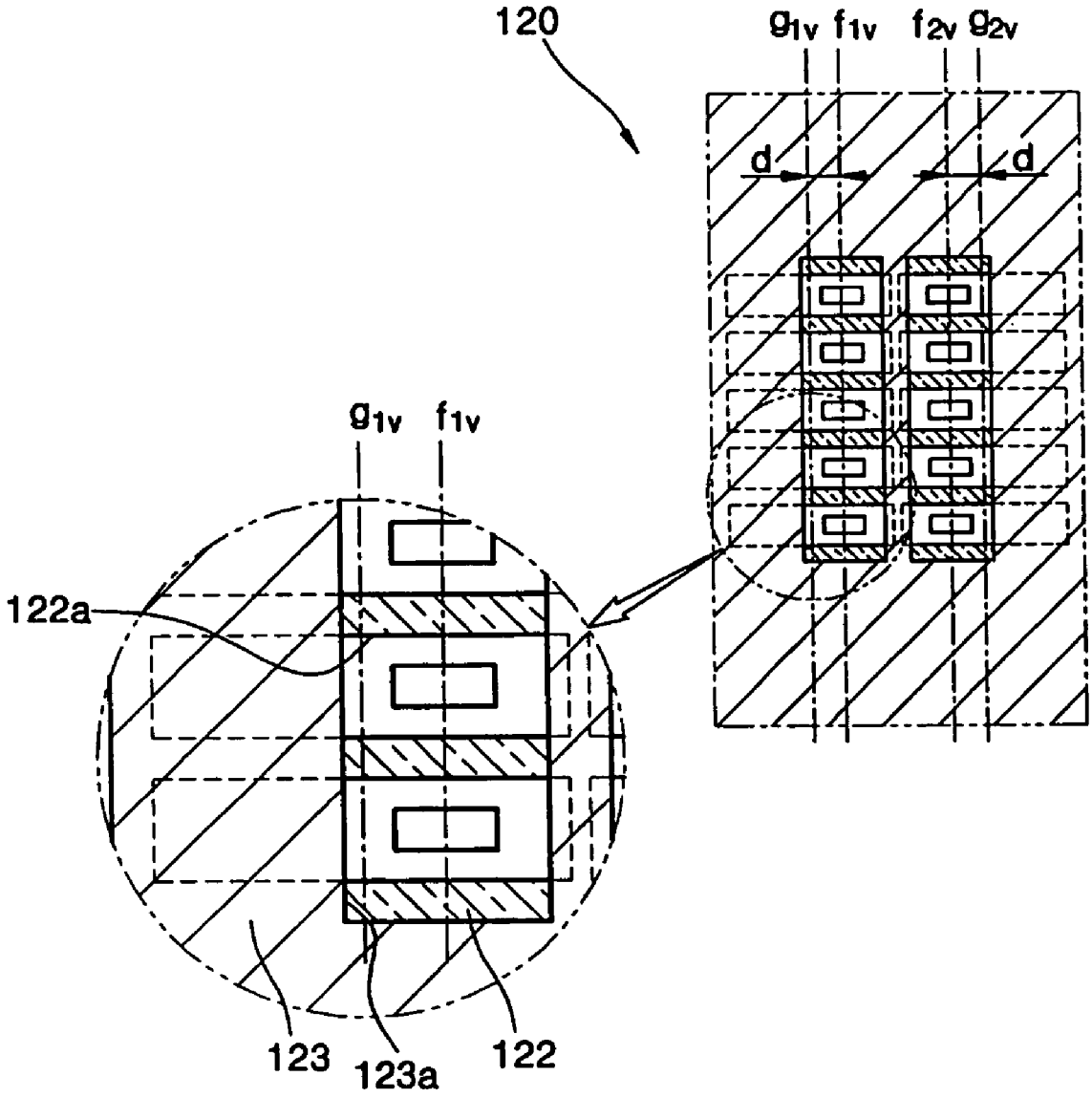
FIG. 12 is a plan view of an FED according to a fifth embodiment of the present invention.

FIG. 12 is a plan view of an FED according to a fifth embodiment of the present invention. The FED 120 according to the present embodiment includes two or more groups of emitters arranged in a horizontal row, distinguished from the fourth embodiment in which two or more groups of emitters are arranged in a vertical row. Further, groups of electron beams from the groups of the emitters are focused on the center of the groups of emitters to prevent the horizontal width of electron beams from increasing.

According to the fifth embodiment, the FED 120 includes two groups of emitters extending vertically, and the two groups are disposed side by side horizontally. First opening portions 122*a* of a gate electrode 122 corresponding to the emitters of one of the two groups are deviated from the center of the two groups. That is, the vertical axis $g_{1v}$ of the first opening portions 122*a* is deviated a distance "d" from the vertical axis $f_{1v}$ of a second opening portion 123*a*, and thus electron beams are deflected. Here, the voltage of the gate electrode 122 including the first opening portions 122*a* is higher than the voltage of the focus electrode 123 including the second opening portion 123*a*, and thus electrons beams are deviated to the center of the two groups.

In the other of the two groups, a vertical axis $g_{2v}$ of the first opening portions is deviated with a distance d away from the vertical axis $f_{2v}$ of second opening portion of the group, and electron beams are deflected to the center of the two groups. Accordingly, electron beams emitted from the two or more groups can overlap within a narrow horizontal width when they reach a corresponding fluorescent pattern.

Figure 13:
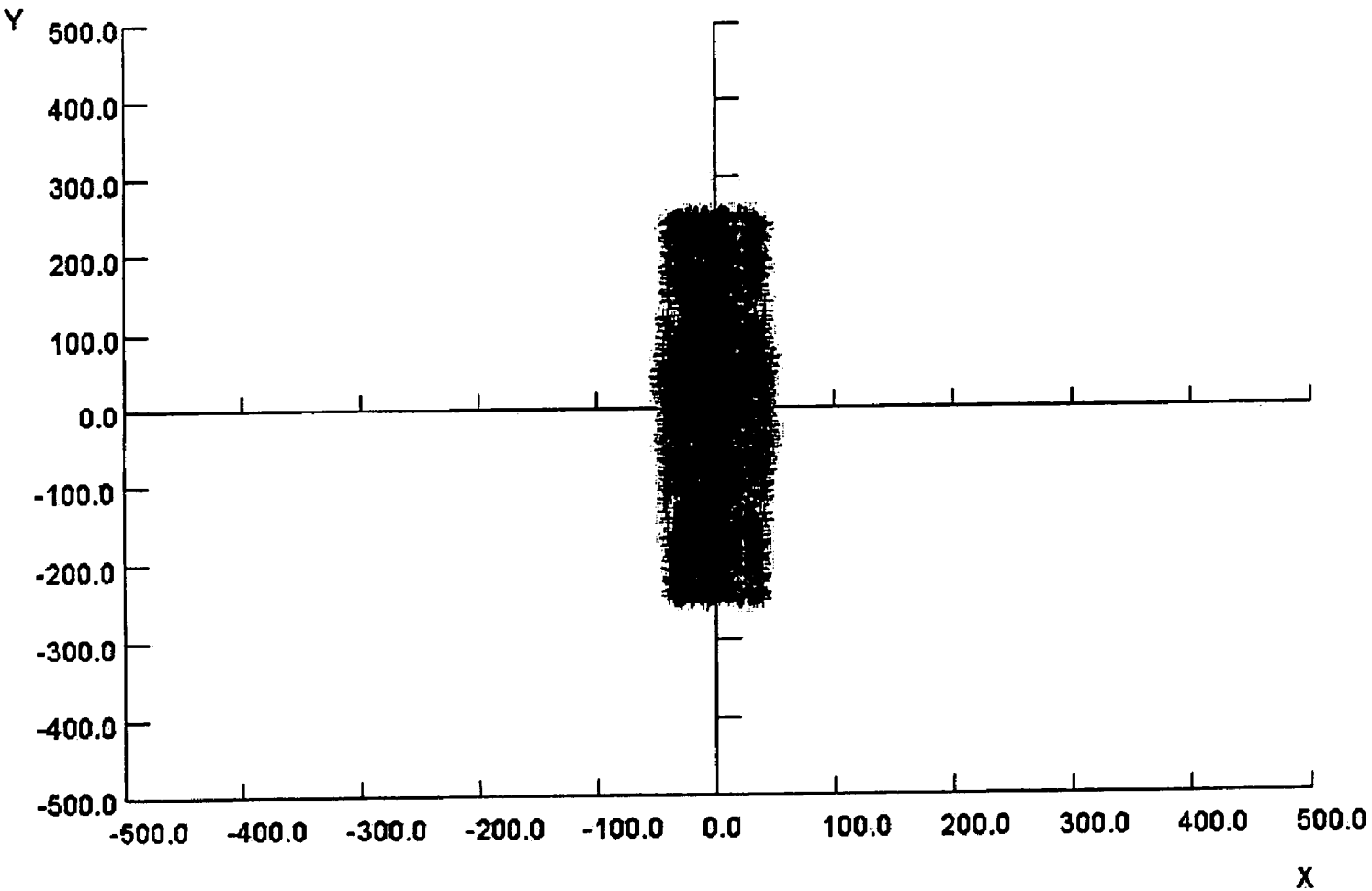
FIG. 13 is a simulation image of an electron beam spot that reached the surface of an anode of the FED illustrated in FIG. 12 according to a fifth embodiment of the present invention.

FIG. 13 is a simulation image of an electron beam spot that has reached the surface of an anode according to the fifth embodiment of the present invention. Maintaining the horizontal width of electron beams as when emitters are arranged in a row of shapes, the FED 120 according to the fifth embodiment provides high brightness by overlapping electron beams output by two groups of emitters.

The FED according to the present invention focuses electron beams emitted from the emitters and transforms a cross-section of electron beams into a striped form corresponding to a fluorescent pattern, and thus provides high brightness and color purity.

Moreover, the FED according to the present invention provides a focus electrode with a small potential difference with respect to a gate electrode. Also, the FED according to the present invention focuses electron beams from the groups of the emitters arranged in a vertical row to the center of the groups of the emitters corresponding to a pixel area. Furthermore, when two or more groups of emitters are arranged in a horizontal row with respect to a pixel area, electron beams from the groups are focused to the center of the groups.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A field emission device, comprising:

a rear substrate;

a cathode electrode on an upper surface of said rear substrate;

at least one group of emitters for emitting electron beams and arranged in a row extending in a first direction on an upper surface of said cathode electrode;

a gate electrode placed on said upper surface of said cathode electrode and extending in said first direction for extracting electrons from the emitters, and including first opening portions extending in a second direction perpendicular to said first direction and respectively corresponding to respective ones of the emitters;

a first insulating layer interposed between said gate electrode and said cathode electrode;

a focus electrode placed on an upper surface of said gate electrode and including a second opening portion extending in said first direction and connected to the first opening portions;

a second insulating layer interposed between said focus electrode and said gate electrode;

a front substrate disposed a predetermined distance above said rear substrate and having an anode electrode on a lower surface thereof; and a fluorescent pattern formed on a lower surface of said anode electrode for emitting light when electron beams collide with it;

wherein a relatively high voltage is applied to the first opening portions and a relatively low voltage is applied to the second opening portion connected to the first opening portions, whereby a quadruple lens structure is formed.

2. The field emission device of claim 1, wherein said at least one group of emitters includes at least two emitters in the row extending in the first direction.

3. The field emission device of claim 1, wherein a potential of said gate electrode is higher than a potential of said focus electrode.

4. The field emission device of claim 3, wherein the potential of said focus electrode is a ground potential.

5. The field emission device of claim 3, wherein the potential of said focus electrode ranges from −30 volts to 0 volts.

6. The field emission device of claim 3, wherein each one of the first opening portions is one of a rectangle and an oval extending in the second direction, and the second opening portion is one of a rectangle and an oval extending in the first direction.

7. A field emission device, comprising:

a rear substrate;

a cathode electrode disposed on an upper surface of said rear substrate;

at least two groups of emitters for emitting electron beams and arranged in a row extending in a first direction on an upper surface of said cathode electrode;

a gate electrode placed on said upper surface of said cathode electrode for extracting electrons from the emitters, and including first opening portions extending in the first direction and respectively corresponding to respective ones of the emitters;

a first insulating layer interposed between said gate electrode and said cathode electrode;

a focus electrode placed on an upper surface of said gate electrode and including a second opening portion extending in a second direction perpendicular to said first direction and connected to the first opening portions;

a second insulating layer interposed between said focus electrode and said gate electrode;

a front substrate disposed a predetermined distance above said rear substrate and having an anode electrode on a lower surface thereof; and a fluorescent pattern formed on a lower surface of said anode electrode for emitting light when the electron beams collide with it, at least two groups of emitters being arranged in a row extending in the first direction;

wherein a relatively high voltage is applied to the first opening portions and a relatively low voltage is applied to the second opening portion connected to the first opening portions, whereby a quadruple lens structure is formed; and wherein the quadruple lens structure deflects groups of electron beams emitted from each group of the emitters accommodating at least two electron beams which overlap with one another.

8. The field emission device of claim 7, wherein the first opening portions are deviated in the first direction from an axis of the corresponding emitters extending in the second direction, and deflect the electron beams in a direction opposite to the first direction.

9. The field emission device of claim 8, wherein the first opening portions corresponding to a group of emitters are deviated in a same direction and by a same amount from a center of one group of the emitters, and the same direction of deviation is opposite to a direction of a center of the groups of emitters.

10. The field emission device of claim 7, wherein a potential of said gate electrode is higher than a potential of the focus electrode.

11. The field emission device of claim 10, wherein the potential of said focus electrode is a ground potential.

12. The field emission device of claim 10, wherein the potential of said focus electrode ranges from −30 V to 0 V.

13. The field emission device of claim 7, wherein each one of the first opening portions has approximately one of a rectangle shape and an oval shape extending in the first direction, and the second opening portion has approximately one of a rectangle shape and an oval shape extending in the second direction.

14. A field emission device, comprising:

a rear substrate;

a cathode electrode on said rear substrate;

a first group of emitters for emitting electron beams and disposed in a row extending in a first direction on said cathode electrode;

a gate electrode disposed on said cathode electrode for extracting electrons from the first group of emitters and including first opening portions extending in a second direction perpendicular to the first direction and respectively corresponding to respective emitters of the first group of emitters;

a focus electrode placed on an upper surface of said gate electrode and including a second opening portion extending in the first direction and connected to the first opening portions of the corresponding emitters of the first group of emitters;

an insulating layer interposed between said focus electrode and said gate electrode;

a front substrate disposed a predetermined distance above said rear substrate and having an anode electrode disposed on said front substrate; and a fluorescent pattern formed on said anode electrode for emitting light when the electron beams collide with it.

15. The device of claim 14, wherein the first group of emitters comprise at least two emitters, the first opening portion being one of a rectangle shape and an oval shape, said one of the rectangle shape and the oval shape being longer in the second direction than in the first direction, and the second opening portion being longer in the first direction than in the second direction.

16. The device of claim 14, wherein the fluorescent pattern comprises a stripe extending in the first direction in a rectangle shape which is longer in the first direction than in the second direction with respect to a pixel.

17. The device of claim 14, wherein at least one of the emitters of the first group of emitters deviates a predetermined distance from an axis extending in the second direction of the second opening portions.

18. The device of claim 14, further comprising a second group of emitters extending in the first direction and disposed side by side in the second direction with said first group of emitters, and including the first opening portions and the second opening portion, an axis of the first opening portions extending in the first direction being deviated a certain distance from a an axis of the second opening portion extending in the first direction of the first group of emitters and the second group of emitters.

19. The device of claim 14, further comprising a second group of emitters extending in the first direction and disposed side by side in the first direction with said first group of emitters, the first opening portions and the second opening portion corresponding to each of the first and second groups of emitters.

20. The device of claim 14, wherein a relatively high voltage is applied to the first opening portion and a relatively low voltage is applied to the second opening portions connected to the first opening portions, whereby a quadruple lens structure is formed.

* * * * *